US008789787B2

(12) United States Patent
Kling et al.

(10) Patent No.: US 8,789,787 B2
(45) Date of Patent: Jul. 29, 2014

(54) SUPPLY PACKAGE HAVING SUPPORT ELEMENT WITH RFID

(71) Applicant: SCA Hygiene Products AB, Göteborg (SE)

(72) Inventors: Robert Kling, Skene (SE); Anders Olsson, Mölndal (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 13/726,873

(22) Filed: Dec. 26, 2012

(65) Prior Publication Data

US 2013/0112801 A1 May 9, 2013

Related U.S. Application Data

(63) Continuation of application No. 12/096,633, filed as application No. PCT/SE2005/001873 on Dec. 7, 2005, now Pat. No. 8,366,035.

(51) Int. Cl.
*B65H 26/00* (2006.01)
*B65H 43/00* (2006.01)

(52) U.S. Cl.
USPC ..... 242/563; 242/561; 242/560; 242/598.3; 242/598.6; 242/606; 242/613.2; 242/563.2; 242/564.4; 340/572.8; 340/572.1; 235/492; 221/14

(58) Field of Classification Search
USPC ..... 221/14; 340/572.8, 572.1; 235/492; 242/561, 560, 598.3, 598.6, 606, 242/613.2, 563, 563.2, 564.4
See application file for complete search history.

(56) References Cited

U.S. PATENT DOCUMENTS

| | | | | |
|---|---|---|---|---|
| 3,405,728 | A * | 10/1968 | Dexter | 137/251.1 |
| 5,381,984 | A * | 1/1995 | Hindsgual | 242/613.5 |
| 5,495,997 | A | 3/1996 | Moody | |
| 5,997,195 | A * | 12/1999 | Burgin | 400/242 |
| 6,092,760 | A * | 7/2000 | Hedrick | 242/598.3 |
| 6,362,738 | B1 * | 3/2002 | Vega | 340/572.1 |
| 6,412,655 | B1 | 7/2002 | Stuetzel et al. | |
| 6,631,574 | B2 | 10/2003 | Okyere | |
| 6,958,697 | B2 * | 10/2005 | Morello et al. | 340/572.1 |
| 7,028,861 | B2 | 4/2006 | Sayers et al. | |
| 7,032,818 | B2 * | 4/2006 | Thomas et al. | 235/381 |
| 7,726,599 | B2 * | 6/2010 | Lewis et al. | 242/563 |
| 7,793,608 | B1 | 9/2010 | Udouj | |
| 8,366,035 | B2 * | 2/2013 | Kling et al. | 242/563 |
| 2002/0005774 | A1 * | 1/2002 | Rudolph et al. | 340/5.61 |
| 2004/0090332 | A1 * | 5/2004 | Morello et al. | 340/572.8 |

(Continued)

FOREIGN PATENT DOCUMENTS

| | | | |
|---|---|---|---|
| GB | 2429694 A | * | 3/2007 |
| WO | 0063100 | | 10/2000 |

(Continued)

*Primary Examiner* — Gene O. Crawford
*Assistant Examiner* — Rakesh Kumar
(74) *Attorney, Agent, or Firm* — Buchanan Ingersoll & Rooney PC

(57) ABSTRACT

An apparatus for dispensing sheet material pertains to a housing (82) arranged for receiving a supply of sheet material (1), a feed mechanism (2) for advancing said sheet material through a discharge opening (100) of said housing (82), a motor (3) for driving said feed mechanism (2) and a controller (4) for powering the motor (3) to drive the feed mechanism.

17 Claims, 9 Drawing Sheets

(56) References Cited

U.S. PATENT DOCUMENTS

| | | | | |
|---|---|---|---|---|
| 2005/0127090 | A1 | 6/2005 | Sayers et al. | |
| 2005/0139731 | A1* | 6/2005 | Park et al. | 248/27.3 |
| 2005/0145745 | A1* | 7/2005 | Lewis et al. | 242/563 |
| 2005/0171634 | A1* | 8/2005 | York et al. | 700/231 |
| 2005/0178781 | A1 | 8/2005 | Welchel et al. | |
| 2005/0210610 | A1* | 9/2005 | Louie et al. | 15/102 |
| 2005/0237199 | A1* | 10/2005 | Bellum et al. | 340/572.8 |
| 2005/0237200 | A1* | 10/2005 | Bellum et al. | 340/572.8 |
| 2007/0045465 | A1* | 3/2007 | Oettershagen | 242/599.3 |
| 2007/0054557 | A1* | 3/2007 | Larsson | 439/610 |
| 2007/0114321 | A1* | 5/2007 | Cattacin et al. | 242/596 |
| 2007/0267532 | A1* | 11/2007 | Phelps | 242/596 |
| 2008/0067281 | A1 | 3/2008 | Zeiron | |
| 2008/0142632 | A1 | 6/2008 | Larsson | |
| 2008/0142652 | A1* | 6/2008 | Johnson | 248/176.1 |
| 2008/0164369 | A1* | 7/2008 | Adelakun | 242/579 |
| 2009/0127350 | A1* | 5/2009 | Dobler et al. | 239/53 |
| 2011/0006145 | A1* | 1/2011 | Denis et al. | 242/160.4 |
| 2011/0082595 | A1* | 4/2011 | Mehus et al. | 700/283 |

FOREIGN PATENT DOCUMENTS

| | | |
|---|---|---|
| WO | 2004049246 | 6/2004 |
| WO | 2004061787 | 7/2004 |
| WO | 2005065509 | 7/2005 |

* cited by examiner

Memory Map

| | Bit 0 — Bit 31 | |
|---|---|---|
| Word 0 | PASSWORD | EE |
| 1 | PROTECTION WORD | EE |
| | CONTROL WORD | EE |
| 3 | 926 bits of USER EEPROM | EE |
| 31 | | |
| 32 | DEVICE SERIAL NUMBER | Laser |
| 33 | DEVICE IDENTIFICATION | Laser |

FIG. 3

| Address | Contents |
|---|---|
| 0x00 | Password |
| 0x01 | Protection word |
| 0x02 | Control word |
| 0x03 | Paper roll status |
| 0x04 | Product ID |
| 0x05 | Production date |
| 0x06 | Paper length / Number of sheets |
| 0x07 | Weight calculation factor |
| 0x08-0x0x | Contact information / customer link |
| 0x0y-0x0z | User information |
| 0x20 | Device serial number |
| 0x21 | Device identification |

FIG. 4

SUPPLY PACKAGE HAVING SUPPORT ELEMENT WITH RFID

CROSS REFERENCE TO RELATED APPLICATIONS

This application is a continuation of copending application Ser. No. 12/096,633 filed on Jun. 9, 2008; which is the 35 U.S.C. 371 national stage of International application PCT/SE05/01873 filed on Dec. 7, 2005. The entire contents of each of the above-identified applications are hereby incorporated by reference.

TECHNICAL FIELD

The invention relates to a supply package for an apparatus for dispensing sheet material. In particular the invention relates to a supply package for use in an apparatus for dispensing a web of sheet material from a supply of sheet material, notably from a supply in the form of a roll, by use of a motor coupled to a feeding mechanism which dispenses sheet material upon activation of said motor in dependence of information stored in a memory circuit in a radio frequency identification tag applied on the supply package.

The invention also relates to an apparatus for dispensing sheet material.

BACKGROUND ART

Dispensers for dispensing sheet material are well known in the art. Dispensers are either manually operated, that is sheet material is fed from the dispenser by manual actuation, either directly on the paper or on a feed mechanism manually powered, or automatically operated. In the event the dispenser is automatically operated a motor is included in the dispenser to operate a feed mechanism. The present invention relates to a supply package for an automatically operated dispenser including a motor and a feed mechanism. Generally automatic dispensers for dispensing sheet material can be divided into two separate groups, that is, dispensers suitable for dispensing individual pre-cut towels that are stacked in a supply in a folded or unfolded manner and dispensers suitable for dispensing sheet material from a continuous roll, which sheet material is cut into pieces of suitable length. The action of cutting may be manual, for example by tearing against a saw teethed blade, or automatic. In the event the cutting action is automatic a cutter and a cutter drive mechanism is incorporated in the device.

An example of an automatic dispenser for sheet material is known from WO00/63100. WO00/63100 relates to an apparatus for dispensing a web of sheet material from a continuous roll, which apparatus comprises a housing having a discharge opening, a support for rotatably supporting a roll of paper, a feed mechanism for advancing the sheet material and a controller for powering the motor to drive the feed mechanism. The controller enables automatic dispensing of a predetermined, but yet variable length of paper. Furthermore the controller is used to monitor the use and function of the dispenser. The controller communicates via an IR-emitting bi-color LED with a hand held device with an integral IR transceiver. Updating of system parameters such as towel length, dispense delay and operating mode is performed by manually pressing pushbuttons arranged on a control panel arranged on the dispenser.

When managing numerous dispensers for ensuring that the dispensers are operative and that their supplies of sheet material does not remain empty during unnecessary long time periods it is of importance that the time period required for service of each station is as small as possible and that the need for maintenance, such as replenishment of supply, is effectively communicated to managing staff.

Supplies of sheet material for dispensers generally come in different lengths depending on individual variation as well as the quality and type of sheet material used. Managing of a system of numerous dispensers of the type as disclosed in WO00/63100 may be time consuming for an operator which must ensure that the size of the supply recorded in the control system corresponds to the actual size of the supply that is loaded into the dispenser.

In order to ensure appropriate operation, the operator must check the recorded value of supply size and compare the size with the actual size of the refill, which both operations are tedious, time consuming and requires attention in order not to be performed erroneously. First, it is common that the lengths of the supplies are only noted on pallets on which the individual supplies are provided or on boxes or cases in which supplies are provided. Supplies are separated from this pack material before it is carried to the dispenser. The operator may therefore not have access to correct information when refilling the dispenser. Furthermore, the updating procedure is time consuming since the operator must select operation mode and increase or decrease the size of the recorded supply by pressing pushbuttons numerous times. Additionally, the control system of the type as disclosed in WO00/63100 is relatively easy to tamper, since control buttons for setting the operational parameters of the dispenser are provided on a control panel on the dispenser. A risk for unauthorised manipulation of the system therefore exists. Finally, if even possible, it would be very time consuming for an operator to remove a supply which has been in use in one dispenser and therefore is not of original size and to use this as a refill in another dispenser, since the operator would have to get access to the actual length of the supply, which may not be possible and enter this data in the system, which is time consuming.

In US200510145745 an apparatus for dispensing sheet material is disclosed. The sheet material dispenser disclosed therein includes a controller for automatically controlling the lengths of sheet materials dispensed from a continuous roll by identifying the type of sheet materials on the roll and dispensing suitable lengths of the identified sheet material. The dispenser has a support for rotatably supporting a roll of sheet material carrying identification relating to the type of sheet material on the roll, and an identifier positioned in or adjacent the dispenser for identifying the type of sheet material on the roll. The identifier may be a radio frequency identification (RFID) tag. A processor receives data from the identifier, processes the data and generates an output command, and a controller controls the lengths of sheet material dispensed from the roll in response to the output command. In this way, more absorbent products may be dispensed in shorter lengths and less absorbent products may be dispensed in longer lengths.

The dispenser disclosed in US200510145745 allows for efficient handling of sheet material resources since the feeding of the sheet material may be adapted to the type of material used and since the dispenser may be programmed to reduce paper waste in different situation. Even so, the use of complex identifiers such as RFID tags have introduced further problems since this type of identifiers includes components made of metals, semiconductors plastics and other materials that may require special attention when recycling. Recycling is used to reduce the environmental load from commercial and industrial activities. In paper industry recycling is widely spread. It is for instance common to recycle used paper towels for further use as raw material in paper industry. Used cores in paper rolls may also be recycled without concern for negative environmental impacts. Even though use of RFID tags may improve the efficiency and service level of dispensers it is of importance that easy and efficient recycling can be guaranteed. By introducing an RFID tag in the core as has been suggested in US200510145745 recycling of the core element becomes difficult. The fact that the core element is made of paper may lead to that consumers tries to recycle the core together with other goods made of paper, which would lead to that the RFID circuit including metals, semiconductors and plastics contaminates paper raw material and that complex circuits are destroyed in the recycling process of the paper, which both are negative in a recycling aspect. It is also known that RFID circuits in waste material may influence function of adjacent equipments in an intended way.

SUMMARY OF INVENTION

An object of the invention is to provide a supply package for dispenser which enables efficient and accurate management of refill of supplies, such that estimated time consumption for handling large numbers of dispensers is reduced and where the risk for entering inaccurate data into the system is low. A further object of the invention is to provide a supply package for use in a dispenser, which supply package enables easy and efficient recycling. These two objects are achieved by a supply package according to the invention.

According to the invention the supply package includes a supply of sheet material and a support element which is attached to said supply of sheet material in a manner such that it may be released from said supply of sheet material before said supply of sheet material is empty, said support element thereby being transferable between different supplies of sheet material and being arranged to cooperate with a connector device arranged in said apparatus for locating said supply of sheet material in a dispensing position in said apparatus.

The support element includes a radio frequency identification tag, including an antenna and a memory circuit, which antenna is adapted to communicate with a radio frequency identification base station arranged in the dispenser, and which memory circuit contains stored information adapted to be readable for a controller in the dispenser.

Since the support element is releasably attached to the supply of sheet material, the support element may be reused for carrying further supplies, which reduces the environmental load of the support in the meaning of conventional life cycle analyses. In the event the support element are reused in the present shape, that is not to be recycled as raw material, but attached to a new supply of sheet material, the radio frequency tag has to be unlocked from a status defining the supply as empty before the tag is being reused.

The use of a support that may be attached to the supply of sheet material in a late stage of the manufacturing process of the supply of sheet material, preferably after the supply of sheet material is complete, which in the event it concerns a stack of paper towels would mean that the stack includes the intended number of paper towels and in the event it concerns a paper roll, the roll is formed into its intended size. Late attachment of the support element to the supply of sheet material means that it is possible to use a more limited number of support elements than the actual number of supplies of sheet material since the support element may be reused repeatedly. It may therefore be advantageous to attach the support element immediately prior to packaging of the supplies for delivery to consumers.

In a preferred embodiment the support element intended for a supply of sheet material in the form of a roll of sheet material wound on a core, having a cylindrical mantle and two end portions. In this event the support element is preferably constituted by at least one end plug releasably inserted in said core at one of said end portions for providing a support for said core in a connector device arranged in the dispenser. It is also possible, in the event a coreless roll is used to provide a support element which is engaged with the roll into a side portion thereof at a central position for forming the rotational axle of the roll. The support element may extend through the complete width of the roll along the rotational axle such that it protrudes on both sides of the roll such to form a support for rotation of the roll at both ends of the support element, or may be formed by two separate support elements each being introduced at opposing side portions of the roll. In this event it is sufficient that one of the support elements includes an RFID tag. In the event the supply of sheet material is constituted by a roll, with or without a core, it is generally preferable that the support element includes a roll engagement portion which, in use, extends into the roll beyond end faces of the roll and a protruding portion extending out from the end face to constitute a support to be carried by a connectors device, for instance in the form of a holder, arranged in the dispenser.

In the event the supply of sheet material is in the form of a solid or coreless roll, having a cylindrical mantle and two end portions, the support element is preferably constituted by an adapter having a first end adapted to be attached to said connector device and a second end including a planar surface coated with adhesive thereby being adapted to be attached to the end portion of said roll.

In the event the supply of sheet material is in the form of a coreless roll, having a cylindrical mantle and two end portions, the support element is preferably constituted by adapter having a first end adapted to be attached to the connector device and a second end including a protrusion, which is preferably cone shaped, said protrusion being introduced into a central opening provided in the end portions of the roll.

Alternatively the supply of sheet material may be in the form of a stack of sheets in a cartridge containing one or more stacks of sheets. In one preferred embodiment the support element is the cartridge or at least part of the cartridge, preferably the inner lower portion of the cartridge.

In one embodiment the supply of sheet material is in the form of a bundle of a continuous length of accordion-like folded web of sheet material. A plurality of such bundled may be positioned on top of each other and connected to each other via connecting means which may be provided in the form of an adhesive connecting an end portion of a bundle with the beginning of the next bundle.

The invention furthermore relates to a dispenser for dispensing sheet material.

A dispenser according to the invention utilises a controller for powering a motor coupled to a feed mechanism for feeding sheet material, which controller is provided with a radio frequency identification (RFID) base station having an antenna which is adapted for communication with an antenna on a radio frequency identification tag applied on the supply package. When the supply is loaded into the dispenser, the RFID base station uploads information stored in a memory circuit arranged on the RFID tag.

The apparatus includes a connector device for locating the supply of sheet material for receiving a from the supply of sheet material releasably arranged support element carrying a radio frequency identification tag.

In a further embodiment of the invention, the support element may, after the supply of sheet material has been depleted, be automatically collected by the dispenser for recycling. In the event a roll with a core is used, an automatic separation of the core and the support element may take place. This separation can be effected by pushing the core in the axial extension of the core away from the support element while maintaining the position of the support element. This may be done by a lever actuated when a controller arranged in the dispenser has concluded that the roll is empty. In the event a split core is used it is possible to separate the core from the support element just by allowing the split core to drop from its active position when the last piece of sheet material is removed, and the two or more pieces forming the core become separated. In one embodiment the support element may have an engaging portion, which has a short conical part with its narrow end engaging the core, the support element may be released by allowing the core parts to drop to as soon as the last layer of sheet material is removed. The support element may after its release from the core fall into a separate storage compartment in the dispenser. In the event a coreless roll is used the support element may just be allowed to drop into a storage compartment when the support element is released from the paper. In this event it is advantageous to form the support element with a cone shaped roll engaging portion.

The controller may then utilise the uploaded information to determine drive routines for the motor arranged to feed the sheet material.

As an explanatory embodiment of the invention, the memory of the RFID tag may contain the following information:

| Control | Status | ID | Size | Quality |
|---|---|---|---|---|

The control data is used in a conventional manner for ensuring reliable and safe communication. A status field may be used to verify whether the roll is empty or not. An ID field is used to identify the particular supply or the type of supply that is used in the dispenser. A Size field may be used for information about the size of the supply. The Size field may be continuously updated or alternatively only contain information about the Size of the supply when the supply is full. A quality field may be used to indicate the type and quality of the sheet material.

In the least elaborate embodiment of the invention, the memory of the RFID tag may only make use of an ID field where the identity of the roller or the type of roller is stored as a code. In this event, the controller should be provided with a memory or communication link where information regarding the size of a supply of the type or identity of supply that has been identified via information read from the ID field on the RFID tag is stored.

In another embodiment, the memory of the RFID tag may only make use of a Size field from which the RFID base station may read information regarding the size of the supply, where after the controller may adapt the driving routines for the motor accordingly. The Size field may preferably be continuously updated from the RFID base station as the controller generates information about the amount of sheet material that has been dispensed. Alternatively, the controller may initially upload information about the size of the supply and thereafter perform calculations determining the resulting size of the supply without updating the Size field.

In this event, it is preferred that a Status field is updated from Not Empty to Empty, when the calculations show that the supply is empty. Preferably the controller is arranged such that it includes a control function which upon detection of that the supply is empty, updates a status field provided in said memory circuit from a value indicating that supply is not empty, to a value that the supply is empty and that the control function prevents updating the value of the status field as soon as it has assumed the value indicating that the supply is empty.

The information uploaded from the memory of the RFID tag according to the embodiments disclosed may be used by the controller to prevent the motor to drive the feed mechanism with an empty roller. This saves energy and cost for maintaining the operation of dispensers. This is of particular importance when the motor is driven by batteries, which normally is the case. In order to ensure as long run time of the dispensers without the need to replace batteries unnecessarily often, powering of the motor when the supply is empty should be avoided. One manner allowing the motor to drive the feed mechanism in dependence of information stored in a memory circuit in said radio frequency identification tag is thus to prevent the motor from being driven when the supply is empty.

An other manner allowing the motor to drive the feed mechanism in dependence of information stored in a memory circuit in said radio frequency identification tag would be to prevent the motor from being driven when the supply in not appropriate for use in the type of dispenser in which the supply is loaded. This may be particularly critical when the dispenser is of the type which contains a large set individual sheet material towels, that are stacked on top of each other and possibly are folded and connected to each other for enabling dispensing of one towel at the time. In this event, the drive mechanism is frequently adapted to type of towels and manner in which they are folded. The motor should therefore be prevented from driving the feed mechanism when the controller has not identified that a suitable type of supply has been installed in the dispenser.

A further example of allowing the motor to drive the feed mechanism in dependence of information stored in a memory circuit in said radio frequency identification tag would be to allow the controller to drive the motor at different speeds depending on the quality of the sheet material in the supply.

A final example of allowing the motor to drive the feed mechanism in dependence of information stored in a memory circuit would be to adapt the length of a dispensed continuous web of sheet material in dependence of how much material that remains in the supply. In this manner it would be possible to discharge a first comfort length until the supply is almost empty and thereafter to discharge a shorter length while waiting for replacement of the roll.

The memory circuit of the RFID tag may according to different embodiments make use of only an ID field, only a length field, only a status field and various combinations such as a length field combined with a status field, a status field combined with an ID field, a length field combined with an ID field, the ID, length and status field combined or any other combination of the field mentioned above.

According to an embodiment of the invention, the dispenser may additionally include a separate detector arranged to detect when the supply is empty. This type of detector is not necessary when the individual variation of the size of supplies in the same type of supply is small, such that the size which determined from the RFID tag is sufficiently accurate or when the value of the size stored in the supply accounts for individual variation by individually assigning a value when the supply is filled. However if large individual variation exists within the same type of supply and where this variation is not accounted for when packing the supply a detector may be used to exactly determine when the supply is empty. In the event such a sensor is used, the controller should allow dispensing of sheet material even after the calculations indicates that the supply is empty. Thereafter the status field should preferably be updated from "not empty" to empty" and the motor should be blocked from further operation. In a particularly preferred embodiment, the sensor should be an optical detector arranged to detect the optical appearance of the sheet material whereby said optical detector should be arranged to produce output signals in dependence of whether the supply of sheet material is empty or not. It is also possible to use a mechanical detector in the form of a switch or a mechanical arm that senses the level of the supply to detect if the supply is empty or not.

In order to ensure good signal quality between the RFID base station and the RFID tag without need for excessive power consumption and/or antenna size of the tag and base station, the position of the tag and the base stations is of importance. In a preferred embodiment the dispenser is used for dispensing sheet material from a roll containing a continuous web of sheet material. In this event the housing includes a support member allowing rotation of said roll around a symmetry axis of said roll. The antenna of the radio frequency identification base station is, in order to ensure close contact with the tag, preferably mounted in said housing within an area arranged in close contact to an axial extension of said symmetry axis. The close contact may advantageously be achieved in a dispenser which includes a support surface arranged for supporting an end portion of a core onto which said supply of sheet material is wound by mounting the antenna of the radio frequency identification base station at said support surface within an area corresponding to an axial extension of said core.

Preferably, the antenna of the radio frequency identification base station is essentially two dimensional and extends in a plane which is essentially perpendicular to an axis extending along a axial length axis of the core when mounted in said housing. However it is also possible to arrange the antenna in three dimensions, for example as an array or as a spirally wound antenna.

In the event the dispenser is provided with an optical detector for determining paper outage, the supply of sheet material preferably includes a marker which is covered with sheet material when the supply is not empty and which marker is exposed when said supply is empty, said marker having optical characteristics different from said sheet material allowing an optical detector to detect an empty supply.

In the event the supply of sheet material is in the form of a roll of sheet material applied on a core, the core may advantageously constitute the marker by having a different optical characteristic than the sheet material.

In order to ensure good communication quality between the tag and the base station when the supply of sheet material is in the form of a roll having a cylindrical mantle and two end surfaces it is advantageous to apply the radio frequency identification tag in a central portion of at least one of the end surfaces. In the event the core is provided with at least one end plug, it is advantageous to apply the identification tag in an end plug.

The invention also relates to a system for keeping track of need of refilling empty supplies in sheet material dispensers which system includes a set of dispensers as have been described above, wherein the set of apparatuses includes a number of groups of apparatuses where each group of apparatuses includes a wireless transmission link communicating with a base station, said base station being signally connected to a server unit arranged for keeping track of the need for refill of the individual apparatuses in said set of apparatuses. Since dispensers of the type described above normally are operated on batteries, they do not have access to electrical and data networks. In the event a group of dispensers, which group may be consisted of a single dispenser, has access to a wireless transmission link to a base station, no separate wires to the individual dispensers are needed. The base station may be connected to a server through existing data networks. By organising the system in this manner, it is not necessary to reconstruct existing data communications networks when implementing such a system in for example large office buildings.

The dispenser may be controlled according to a method for dispensing sheet material from a dispenser, which method includes the following method steps performed by a controller comprised in the dispenser:

- using a radio frequency identification base station included in the controller to communicate with an antenna in a radio frequency identification tag applied on a supply of sheet material;
- uploading information from a memory cell arranged in said radio frequency identification tag to said radio frequency identification base station; and
- allowing the motor to drive the feed mechanism in dependence of the uploaded information.

In preferred embodiments, the controller may also ensure that the following method steps, alone or in combination:

- An optical detector detecting the optical appearance of the sheet material whereby said optical detector produces output signals in dependence of whether the supply of sheet material is empty or not, which output signals are used by the controller.
- The controller blocks further operation of the motor when a signal indicating that the supply of sheet material is empty has been produced.
- The controller includes a control function which upon detection of that the supply is empty, updates a status field provided in said memory circuit from a value indicating that supply is not empty, to a value that the supply is empty and that the control function prevents updating the value of the status field as soon as it has assumed the value indicating that the supply is empty.
- The controller keeps track of the quantity of sheet material fed from the supply and retrieves information indicating the size of the supply from the memory circuit in said radio frequency identification tag applied on said supply of sheet material.
- The controller calculates the amount of sheet material that remains in the supply by reducing the size of the supply with the quantity of sheet material fed from the supply.
- The radio frequency identification base station transmits a value representing the amount of sheet material that remains in the supply to the radio frequency identification tag and that said value is recorded in a field of said memory circuit representing the remaining size of the supply.
- The controller, upon detection of that the supply is empty, transmits a signal indicating that the supply is empty to the radio frequency identification tag for storage in its memory circuit.

BRIEF DESCRIPTION OF DRAWINGS

An embodiment of the invention will be described in detail below, with references to the following drawings, where:

FIG. 3 shows a memory map of a commercially available RFID tag suitable for this application, FIG. 4 shows a suggested distribution of memory addresses according to one embodiment of the invention.

EMBODIMENT(S) OF THE INVENTION

Figure 1:
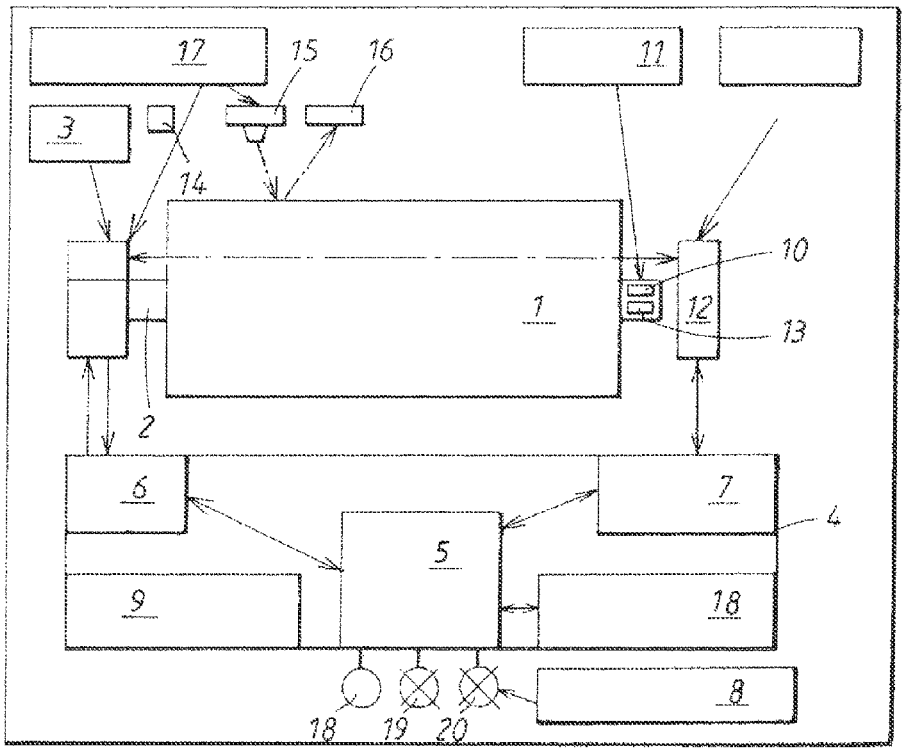
FIG. 1 shows a schematic drawing of a dispenser according to the invention provided with a supply of sheet material in the form of a paper roll.

FIG. 1 shows an apparatus for dispensing sheet material comprising a housing (not shown) arranged for receiving a supply of sheet material 1, a feed mechanism 2 for advancing said sheet material through a discharge opening (not shown) of the housing, a motor 3 for driving said feed mechanism and a controller 4 for powering the motor to drive the feed mechanism. The supply of sheet material 1 is provided in the form of a continuous web provided as a roller. The feed mechanism 2 may be arranged as shown in FIG. 1 as an output axle 2 of the motor 3, which output axle is directly or indirectly via coupling means engaging the roll. Other types of drive mechanisms are well known in the art. It is for instance common to utilise transmissions means between the motor and coupling means engaging the supply for dispensing of sheet material.

The controller 4 includes a micro control unit 5 communicating with a motor control block 6, a RFID base station 7 in the form of a transceiver and a user interface 8.

The motor 3 is connected to a power supply 9. Control of the operation of the motor 3, that is determination of running time for the motor in order to enable a determined dispatch of paper from the supply upon a request to feed sheet material, optionally control of the driving speed of the motor, is performed by the motor control 6 using input data from the micro control unit 5. The communication between the motor 3 and the motor control may be bidirectional where motor control signals are transmitted to the motor 3 and feedback signals from, for example a rotary encoder 14 determining the angular displacement of the output axle of the motor in order to determine the length of dispatched sheet material during operation of the motor.

The controller 4 is arranged to allow the motor 3 to drive the feed mechanism 2 in dependence of information stored in a memory circuit 10 in a radio frequency identification tag 11 applied on the supply of sheet material 1. The a RFID base station 7 therefore collects information from a memory circuit 10 in a radio frequency identification tag 11 by establishing communication between an antenna 12 included in the RFID base station 7 and an antenna 13 included in the RFID tag 11. The RFID base station 7 downloads information from the memory circuit 10 of the RFID tag 11. The downloaded information is then processed by the micro control unit 5 and utilised to create control signals for the motor control block 6. The downloaded information may be stored in a non-volatile memory arranged in the controller.

Optionally the dispenser is provided with an optical detector 15, 16 which may be constituted by a light emitting diode 15 and a detector 16 detected light reflected on the supply of sheet material alternatively reflected by an empty supply. An optical interface 17 is arranged to separate signal values from the detector to establish whether the supply is empty of not. The optical interface is signally connected to the micro control unit.

For facilitating the detection of whether the supply of sheet material is empty or not, the supply of sheet material may include a marker M (see FIGS. 8*b* and 8*c* for illustrative examples) which is covered with sheet material when the supply is not empty and which marker is exposed when said supply is empty, said marker having optical characteristics different from said sheet material allowing an optical detector to detect an empty supply.

The dispenser may also optionally include a communications interface which according to a preferred embodiment supports a wireless communication between the communications interface and a base station.

The user interface is in the embodiment shown in FIG. 1 constituted by a button 18 and two LEDs 19, 20. The push-button 18 activates paper feed in the event a valid paper roll is inserted and not empty.

Figure 2:
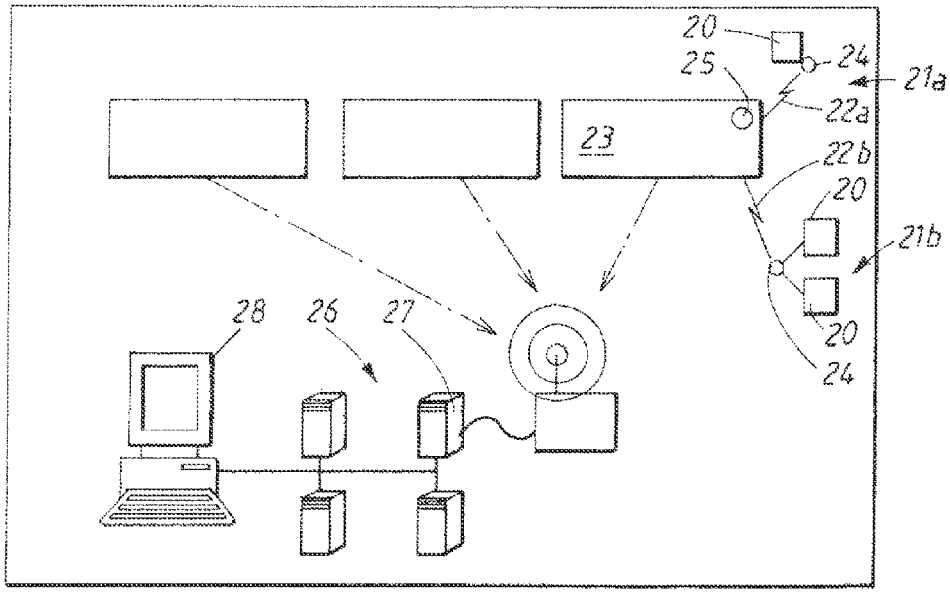
FIG. 2 shows a system for keeping track of need of refilling empty supplies in sheet material dispensers according to the invention.

In FIG. 2 a system for keeping track of need of refilling empty supplies in sheet material dispensers is shown. The system includes a set of dispensers 20 according to the invention as defined above. The set of apparatuses includes a number of groups 21*a*, 21*b* of apparatuses where each group 21*a*, 21*b* of apparatuses includes a wireless transmission link 22*a*, 22*b* communicating with a room base station 23. A room base station 23 is arranged to communicate with one or more groups of apparatuses, typically a one or more groups of apparatuses arranged in a single room. The wireless transmission link can be of any known type. The wireless communication link includes a transmitter or transceiver 24 arranged at each group of dispensers, which transceiver communicates with a receiver or transceiver 25 at the base station.

Each room base station 23 is signally connected to a server unit 26. The server unit 26 may be arranged as a set of floor base stations 27 each being connected to a main server 28. A floor base station 27 acts as a gateway to a network and connects one or more room base stations with a main server 28. The communication between the room base stations 23 and the floor base stations 27 may be wireless or wired. The server 28 or server unit 26 is arranged for keeping track of the need for refill of the individual apparatuses in a set of apparatuses.

A commercially available tag suitable for use together with a dispenser according to the invention is the Emmarin 4450 tag supplied by EM Microelectronic. This tag is configured to communicate with an Emmarin EM4095 base station supplied by EM Microelectronic. Both circuits are well known for persons skilled in the art and will not be described in greater detail. In FIG. 3 a memory map of the tag is shown. In the memory, the first address, word 0, constitutes the password, the second address, word 1, constitutes the protection word and the third address, word 2 constitutes the control word. The control word includes 32 bits assigned as follows:

| | |
|---|---|
| 0-7 | First Word read |
| 8-15 | Last Word read |
| 16 | Password Check On/Off |
| 17 | Read After Write On/Off |
| 18-31 | User available |

On means bit set to logic "1"
Off means bit set to logic "0"

The protection word includes 32 bits assigned as follows:

| | |
|---|---|
| 0-7 | First Word Read Protected |
| 8-15 | Last Word Read |
| 16-23 | First Word Write inhibited |
| 24-31 | Last Word Write inhibited |

The password is write only with no read access. The device identification word and serial number words are laser programmable read only and can not be altered. The user data is available between address 3 and address 31 arranged as a 32 bit per memory address.

In FIG. 4 a suitable manner of allocating memory space is disclosed. The different addresses contains the following contents:

Password, Protection word, Control word, Paper roll status, Product ID, Production date; Paper length or Number of sheets, Weight calculation factor, Contact information and/or customer link, User information, Device serial number, Device identification.

The weight calculation factor provides a mapping between used amount of sheets or used length and the weight of the consumed sheet material.

Figure 5:
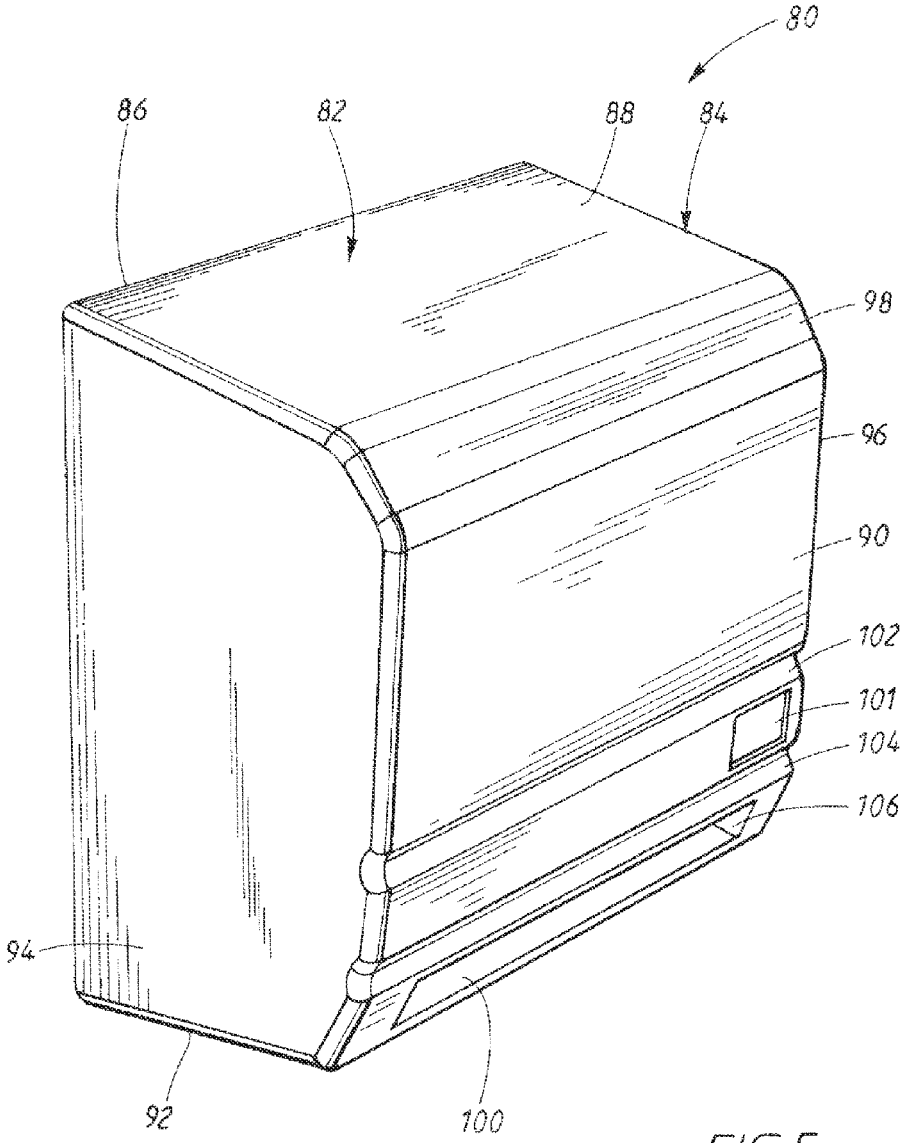
FIG. 5 shows the housing of a state of the art dispenser into which a controller according to the invention can be mounted.

FIG. 5 shows the housing of a state of the art dispenser into which a controller according to the invention can be mounted. The figure shows a perspective view of a sensor-operated electrical dispensing device 80 in the form of a paper towel dispenser with integrated paper roll.

The dispensing device 80 has a housing 82 comprising a hood-like cover 84 and a rear panel 86 attachable to a mounting wall (not shown). The cover 84 is rotatably fastened to the rear panel 86.

The hood-like cover 84 comprises an upper side 88, a front side 90, a lower side 92 and side surfaces 94, 96. Overall the surface of the hood-like cover 84 is closed, smooth and glossy, with the individual sides 88, 90, 92 being at different angles relative to one another, so that a characteristic and dynamic appearance is obtained.

In particular, the upper side 88 is slightly inclined towards the beholder at an angle of preferably about 8 [deg.], so that the placing or leaving of objects such as cigarettes and other rolling objects is prevented. A transitional area 98 or intermediate field is provided between the upper side 88 and the front side 90 and is inclined towards the mounting wall so that the optical appearance of the hood-like cover 84 is matched to a removal opening 100 for towel removal arranged in the lower part of the front side 90.

The housing 82 shown in FIG. 5 is a housing for an electrically operated dispensing device with sensor activation. For visual indication of the removal opening 100 and for localization of a sensor field 101, two horizontally running recesses 102, 104 are provided in the front side 90 of the cover 84. These are semicircular and relief-like grooves which divide the dispenser housing 82 in the golden section, so that a balanced appearance is obtained.

The recesses 102, 144 designed as grooves of semicircular cross-section have a radius selected such that a flawless cleaning of the housing surface is assured. In addition to the informative character of the recesses 102, 104 such as grooves, they also increase the component rigidity, in particular of the front side 90.

To prevent a direct view into the removal opening 100, a housing surface section 106 in which the removal opening 100 has been provided is also inclined towards the mounting wall (not shown).

The rear panel 86 is completely enclosed by the hood-like cover 84, so that it is not visible in the mounted state. An all-round rim (not shown) on a rear side of the dispenser ensures a spacing of approx. 2.5 mm from the mounting wall, so that splash water, condensation etc. can run off unhindered and not get inside the dispenser 80.

Figure 6:
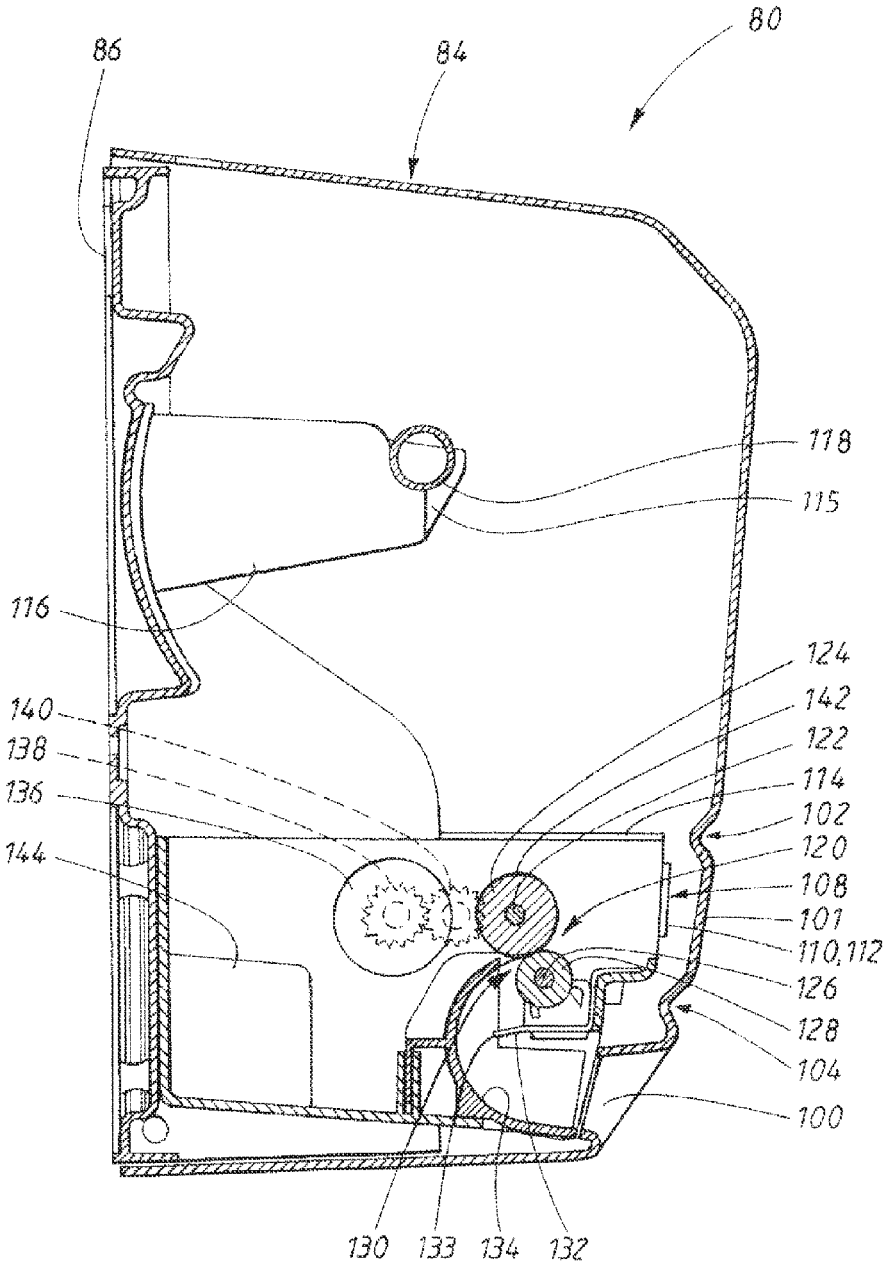
FIG. 6 shows a sectional view of a dispenser in accordance with FIG. 7.

FIG. 6 shows a cross-section through the electrically operated dispensing device 80 in accordance with FIG. 5. The dispensing device 80 may have a capacitive sensor 108, which in the embodiment is arranged directly behind the front side 90. In particular, the capacitive sensor 108 has a two-dimensional electrode 110 and a counter-electrode 112 arranged behind a sensor field 101 that is particularly emphasized by the horizontally running grooves 102 and 104 on the front side. The arrangement of the capacitive sensor 108 on the front side permits considerably more user-friendly handling compared with dispensing devices known from the prior art, since the sensor does not necessarily have to be arranged on the side.

The electrodes 110, 112 run parallel or approximately parallel to the sensor field 101 at least in some areas. The sensor field 101 can cover the entire width of the housing.

Also, the sensor field can be in the area of the abutting front and side surfaces 90, 96 of the housing 80, and in the area of an edge of the housing 80.

The capacitive sensor 108 is connected to an evaluation circuit arranged on a printed circuit board 104.

A connector device 116 in the form of a holder extending from the rear panel 86 is provided and supports a roller 118 for receiving a towel roll, in particular a paper roll (not shown). For dispensing a section of the roll from the removal opening 100, an issuing device 120 is provided.

The feed mechanism 120 comprises a puller roller 124 arranged on a shaft 122 and opposite which a pusher roller 128 is arranged, also on a shaft 126. In a gap 130 formed between the puller roller 124 and the pusher roller 128, a paper strip to be conveyed (not shown) is inserted, and is passed to the outside through the removal opening 30 during operation of the puller roller 124.

For separation of the paper, a cutting edge 132 is provided that in the embodiment shown here is designed as a folded section of sheet metal with cutting edge formed by a toothed pattern at an edge 133 of the folded section of sheet material. The teeth provided on a longitudinal edge 133 of the cutting edge are preferably designed with differing lengths.

The transported paper strip is passed along an arc-shaped guide surface 104 in the direction of the removal opening 100.

In the embodiment shown here in accordance with FIG. 6, a torque is transmitted by means of a motor 136 that can be actuated using the electric actuation device 114. The motor 136 has on the output side a gear 138 that interacts via a further gear 140 with a gear 142 arranged on the shaft 122 of the puller roller 124.

Furthermore, a power supply unit 144 is provided that can be designed both battery-powered and mains-powered.

In connection with the arrangement of the cutting edge 132 or tear-off edge, it must be noted that the latter is arranged on the inside of the housing, so that if anyone reaches into the removal opening 100 contact with the cutting edge 132 is ruled out or at least largely ruled out.

Figure 7A:
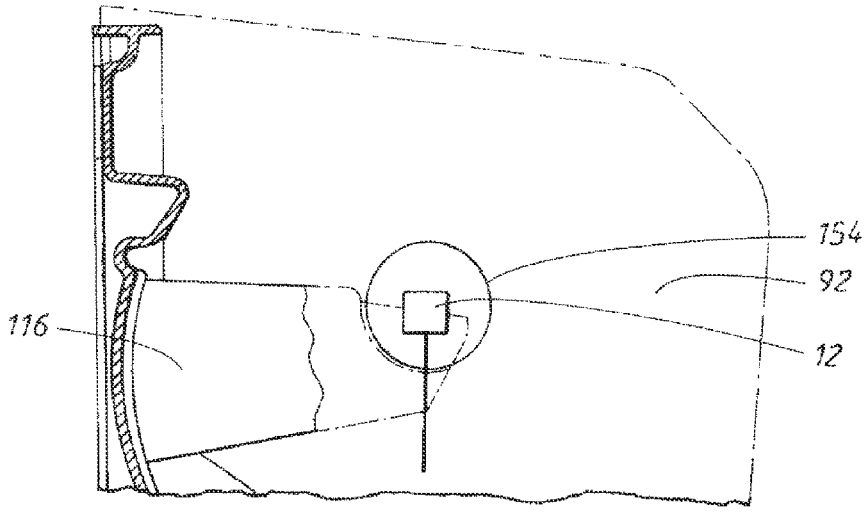
FIG. 7*a* shows the position of a RFID transponder in the side wall of the housing.
Figure 7B:
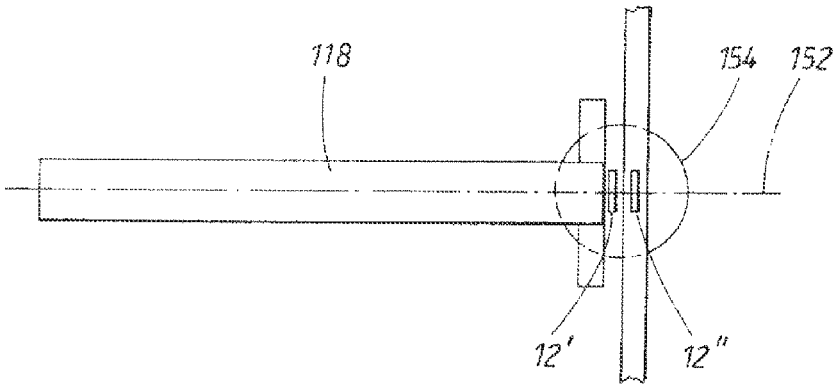
FIG. 7*b* shows alternative positions of the antenna.

FIG. 7 shows the position of a RFID transponder in housing. The figure shows a section of the inside of a side wall 92. A holder 116 is arranged to hold a roller 118 in a recess 150 of the holder. The holder 116 thus constitutes a support member allowing rotation of the roller 118 around a symmetry axis 152 (FIG. 7*b*) of the roller. The antenna 12 of the radio frequency identification base station 7 is mounted in the housing within an area 154 arranged in close contact to an axial extension of the symmetry axis 152. It is suitable to arrange the antenna 12 as closely to the position on the roller 118 where the RFID tag is attached. Since it has shown that it is advantageous to place the RFID tag on an end portion 166 on a core 165 or in the central part of an end portion of a roller in the event the roller does not include a core, the area 154 where the antenna 12 is positioned should be arranged in close contact to an axial extension of the symmetry axis 152. To be in close contact with an axial extension the distance R from the symmetry axis to the antenna in the radial direction should be less than twice the distance Z in the axial extension along the symmetry axis of the roller, from the end of the core, or optionally in the event the core is provided with an adapter in its end portion which adapter is provided with the RFID tag, from the adapter. That is R<2Z, should hold for the position of the antenna. In the event the roller 118 is not provided with the core, the distance should be measured from the side wall of the roller. In this instance the RFID tag is preferably attached at a central location of the side wall.

In FIG. 7*b* two alternative positions of the antenna is disclosed. According to a first alternative, the antenna 12' is positioned in or on the holder. According to a second alternative, the antenna 12" is positioned in or on the side wall 92 of the housing.

Figure 7C:
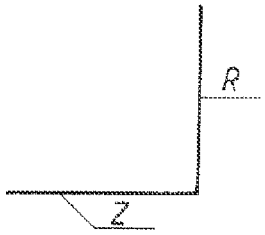
FIG. 7*c* shows a coordinate system for defining appropriate positioning of the antenna.

In FIG. 7*c*, coordinates explaining the radial direction along which the distance R is measured and the distance Z in the axial extension along the symmetry axis of the roller.

In FIG. 8*a*-8*h* different alternatives for appropriate positioning of the RFID tag on the supply of sheet material are shown. The supply is in the form of a roller having a cylindrical mantle 162 (FIG. 8*c*) and two end surfaces 160 defining the external structure of the supply. In each case the radio frequency identification tag 10 is applied in a support element positioned at a central portion of at least one of said end surfaces. The position of the tag should be close to the symmetry axis of the roller. In the event a roller is used the antenna should be positioned on an adapter or support element 164 positioned at one of the end portions 166 of the core 165. The tag should furthermore be positioned close to one of the end portions of the core. In the event a core is not used the antenna should be positioned centrally on the end surface 160 of the core. By "centrally" is herein intended that part of the tag should cover the symmetry axis of the supply. It is possible, in the event a coreless roll is used to provide a support element which is engaged with the roll into a side portion thereof at a central position for forming the rotational axle of the roll. The support element may extend through the complete width of the roll along the rotational axle such that it protrudes on both sides of the roll such to form a support for rotation of the roll at both ends of the support element, or may be formed by two separate support elements each being introduced at opposing side portions of the roll. In this event it is sufficient that one of the support elements includes an RFID tag.

Figure 8A:
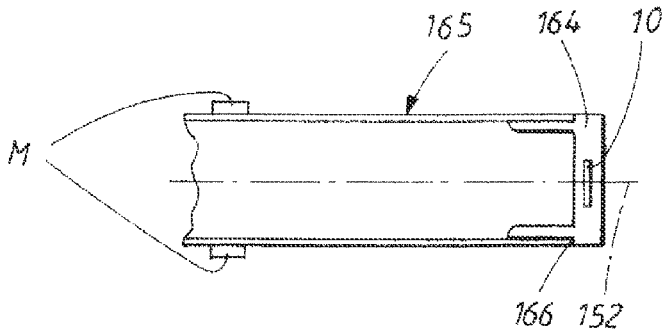
FIGS. 8*a-i* show a supplies of sheet material according to different embodiments of the invention.

In FIG. 8*a* the tag 12 is positioned on or inside a support element or adapter in the form of an end plug 164 releasably inserted in a core 165 at one of said end portions 167. The end plug 165 is used for providing a support for the core 165 in a connector device, which may be supplied in the form of a holder 116.

Figure 8B:
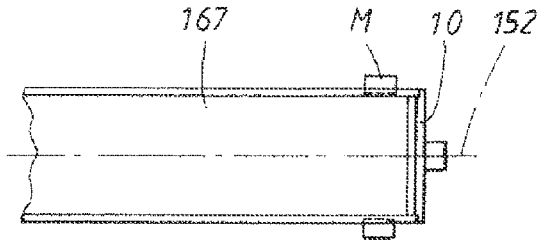

In FIG. 8*b* the tag 12 forms an end plug.

Figure 8C:
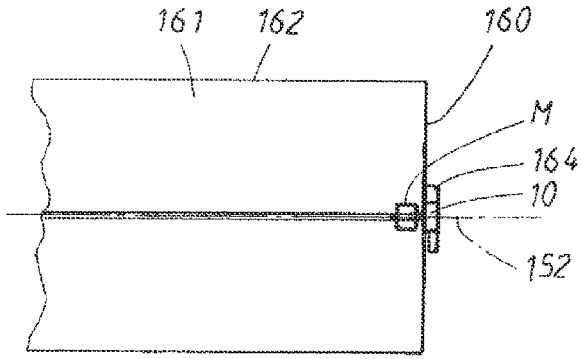

In FIG. 8*c* the support element 164 including a RFID tag 12 is attached at a central portion of the end surface 160 of a coreless supply.

Figure 8D:
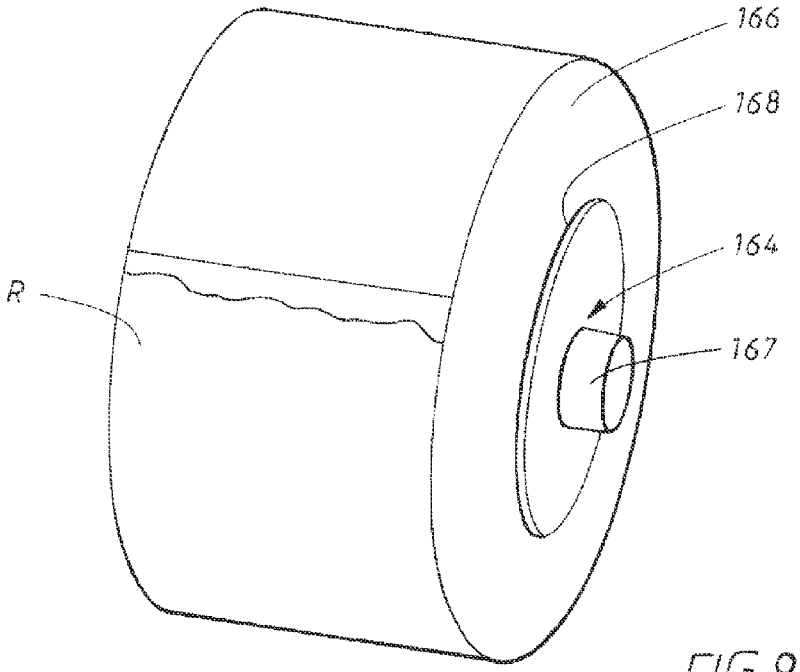

In FIG. 8*d* a support element which is constituted by adapter having a first end 167 adapted to be attached to said connector device 116 and a second end 168 including a planar surface P coated with adhesive thereby being adapted to be attached to the end portion 166 of said roll.

Figure 8E:
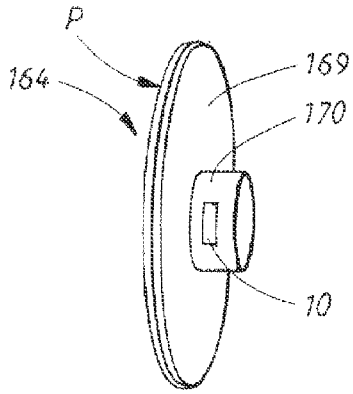

In FIG. 8*e* an embodiment of a support element which is suitable for a coreless or solid roll is shown where the first end 167 is made of a flat plate 169 and wherein the second end 168 is a centrally positioned protrusion 170. The support element carries an RFID tag 10. The planar surface P carries an adhesive.

Figure 8F:
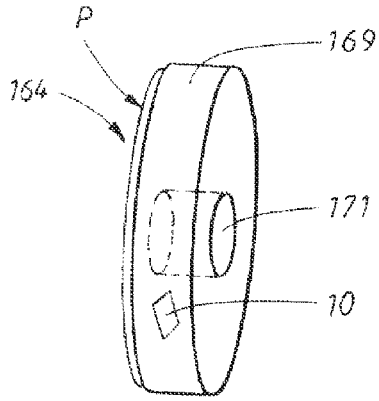

In FIG. 8*f* another embodiment of a support element which is suitable for a coreless or solid roll is shown where the first end 167 is made of a flat plate 169 and wherein the second end 168 is a centrally positioned recess 171 in said plate 169. The support element carries n RFID tag 10. The planar surface P carries an adhesive.

Figure 8G:
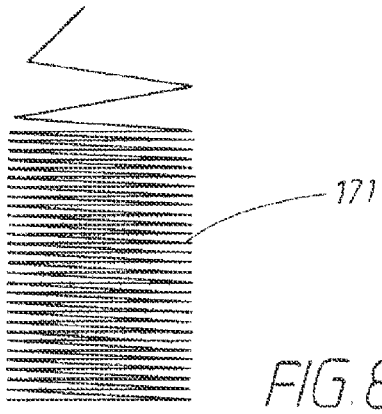

In FIG. 8*g* an embodiment of a supply of sheet material is in the form of a bundle 171 of a continuous length of accordion-like folded web of sheet material.

Figure 8H:
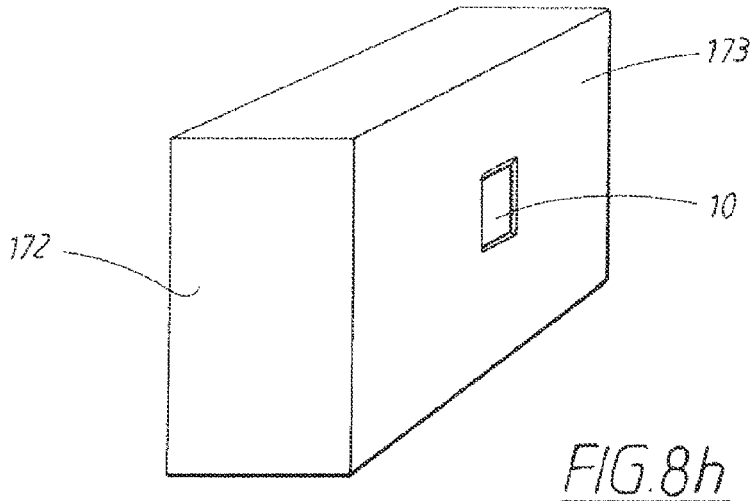

In FIG. 8*h* the bundle of sheet material is covered by a wrap 172 which carries a support element 173 carrying an RFID tag 10.

Figure 8I:
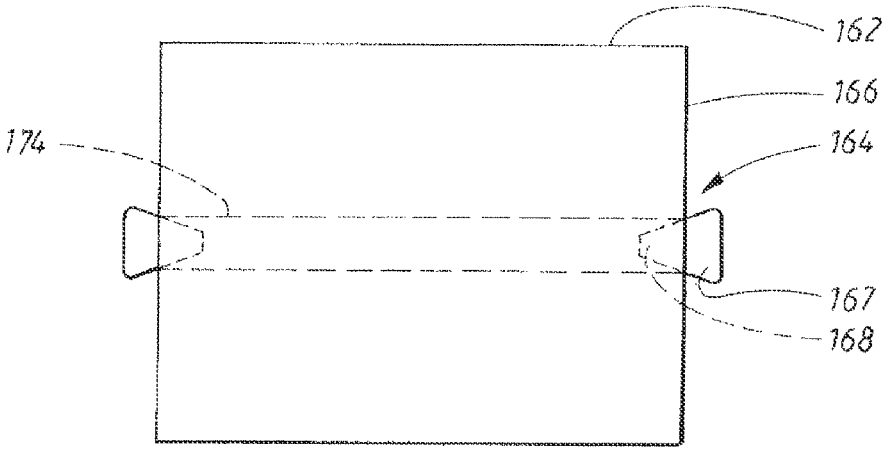

FIG. 8*i* shows a supply of sheet material is in the form of a coreless roll, having a cylindrical mantle 162 and two end portions 166. The said support element 164 is constituted by adapter having a first end 167 adapted to be attached to said connector device 116 and a second end 168 including a protrusion, which is preferably cone shaped, said protrusion being introduced into a central opening provided 174 in the end portions 166 of the roll.

Figure 9A:
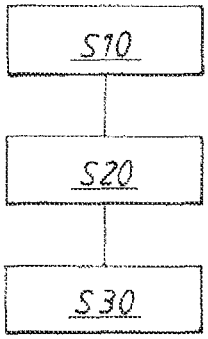
FIGS. 9*a-b* show flow charts for methods for dispensing sheet material according to the invention.
Figure 9B:
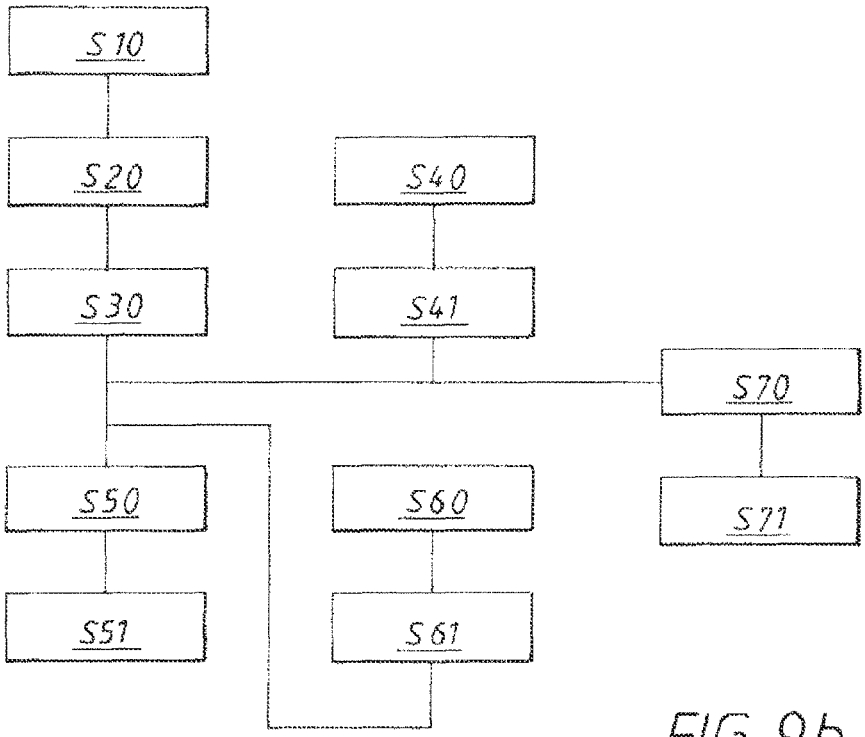

FIGS. 9*a*-9*b* discloses alternative embodiments of a method for dispensing sheet material from a dispenser comprising a housing arranged for receiving a supply of sheet material, a feed mechanism for advancing said sheet material through a discharge opening of said housing, a motor for driving said feed mechanism and a controller for powering the motor to drive the feed mechanism.

According to a first embodiment which is shown in FIG. 9*a* the following steps are performed by the controller:

In a first method step S10 using a radio frequency identification base station included in said controller to communicate with an antenna in a radio frequency identification tag applied on said supply of sheet material; In a second method step S20 uploading information from a memory cell arranged in said radio frequency identification tag to said radio frequency identification base station;

In a third method step S30 allowing the motor to drive the feed mechanism in dependence of the uploaded information.

In a second embodiment of the invention as shown in FIG. 9*b*, the apparatus further includes an optical detector which in a fourth method step S40 detects the optical appearance of the sheet material whereby said optical detector in a fifth method step S41 produces output signals in dependence of whether the supply of sheet material is empty or not.

In a sixth method step S50 the controller blocks further operation of the motor when a signal indicating that the supply of sheet material is empty has been produced.

The controller may furthermore include includes a control function which upon detection of that the supply is empty, which in a seventh method step S51 updates a status field provided in said memory circuit from a value indicating that supply is not empty, to a value that the supply is empty and that the control function in said seventh method step is prevented from updating the value of the status field as soon as it has assumed the value indicating that the supply is empty. This may be performed by using an "or command that verifies if the recorded status value is empty (logical value 1) or if the calculated status value is empty (logical value 1). As soon as the stored value is empty (logical value 1) updating of the value is prevented.

In a further embodiment of the invention the controller performs the following method steps:

The controller may in an optional eight method step S60 keep track of the quantity of sheet material fed from the supply; and retrieves in an optional ninth method step S61 information indicating the size of the supply from the memory circuit in said radio frequency identification tag applied on said supply of sheet material.

In an embodiment of the invention controller calculates the amount of sheet material that remains in the supply by reducing the size of the supply with the quantity of sheet material fed from the supply in said ninth method step S61.

In an optional tenth method step S70 said radio frequency identification base station may optionally transmit a value representing the amount of sheet material that remains in the supply to the radio frequency identification tag and that said value is recorded in a field of said memory circuit representing the remaining size of the supply.

In an optional eleventh S71 method step the controller, upon detection of that the supply is empty, may transmit a signal indicating that the supply is empty to the radio frequency identification tag for storage in its memory circuit.

The invention preferably makes use of a passive RFID tag which retrieves its energy for operation from the RFID base station.

The invention claimed is:

1. An apparatus for dispensing sheet material from a supply package, the apparatus comprising:

a housing arranged for receiving the supply package;

a feed mechanism for advancing said sheet material through a discharge opening of said housing;

a motor for driving said feed mechanism; and a controller for powering the motor to drive the feed mechanism, wherein said controller includes a radio frequency identification base station provided with an antenna adapted to communicate with an antenna in a radio frequency identification tag applied on a releasable support element releasably attached to said supply package, said controller being arranged to allow the motor to drive the feed mechanism depending on information stored in a memory circuit in said radio frequency identification tag applied on said supply package, and a connector device for locating said supply package in said housing so that a signal from the radio frequency identification tag on the releasable support element is receivable at the antenna of the base station, and the supply package is a roll of sheet material having an axis of symmetry extending along an axial direction of the roll of sheet material, the radio frequency identification tag is positioned centrally on the releasable support element to cover the axis of symmetry, and the antenna of the radio frequency identification base station is positioned in the housing to be in the axis of symmetry.

2. The apparatus according to claim 1, wherein said controller includes a control function enabling updating of a status field provided in said memory circuit from a value indicating that supply package is not empty, to a value that the supply package is empty, and the control function is arranged to prevent updating the value of the status field as soon as the status field has assumed the value indicating that the supply package is empty.

3. The apparatus according to claim 1, wherein said controller is arranged to:

keep track of a quantity of sheet material fed from the supply package; and retrieve information indicating a size of the supply package from the memory circuit in said radio frequency identification tag applied on said releasable support element.

4. The apparatus according to claim 3, wherein said controller is arranged to calculate an amount of sheet material that remains in the supply package by reducing the size of the supply package with the quantity of sheet material fed from the supply package.

5. The apparatus according to claim 4, wherein said controller is arranged to transmit a signal indicating the remaining size of the supply package to the radio frequency identification tag for updating the memory circuit.

6. The apparatus according to claim 1, wherein the controller is arranged to transmit a signal indicating that the supply package is empty to the radio frequency identification tag for storage in the memory circuit.

7. The apparatus according to claim 1 wherein the controller is arranged to block further operation of the motor when a signal indicating that the supply package is empty has been produced.

8. The apparatus according to claim 1, wherein said antenna of the radio frequency identification base station is essentially two dimensional and extends in a plane which is essentially perpendicular to an axis extending along a longitudinal axis of said supply package when mounted in said housing.

9. The apparatus according to claim 1, wherein said releasable support element is releasable from said supply package before said supply package is empty, said releasable support element being arranged to cooperate with the connector device arranged in said housing for locating said supply package in a dispensing position in said housing.

10. A system for keeping track of need of refilling empty supplies in sheet material dispensers, said system comprising a set of apparatuses according to claim 1, wherein said set of apparatuses includes a number of groups of apparatuses where each group of apparatuses includes a transmission link communicating with a base station, said base station being signally connected to a server unit arranged for keeping track of the need for refill of the individual apparatuses in said set of apparatuses.

11. The system according to claim 10, wherein said transmission link is wireless.

12. The apparatus according to claim 1, wherein the supply package includes a core supporting the sheet material, and the releasable support element having the radio frequency identification tag is releasably attached to the core.

13. The apparatus according to claim 1, wherein the supply package has a core supporting the sheet material or is a coreless supply package, and the radio frequency identification tag is provided outside the core of the supply package or outside the supply package of a coreless supply package.

14. The apparatus according to claim 1, wherein the radio frequency identification base station is positioned in the housing to be adjacent the radio frequency identification tag.

15. The apparatus according to claim 1, wherein the releasable support element having the radio frequency identification tag is an end plug that is releasably inserted into an end portion of a core supporting the sheet material of the supply package.

16. The apparatus according to claim 15, wherein the core is disposable.

17. The apparatus according to claim 1, wherein the information stored in the memory circuit in said radio frequency identification tag controls a length of sheet material to be dispensed.

* * * * *